US006302092B1

(12) United States Patent
Juan

(10) Patent No.: US 6,302,092 B1
(45) Date of Patent: Oct. 16, 2001

(54) AIR GUN TRIGGER SYSTEM

(76) Inventor: Chih-Chen Juan, No. 278, Lan Tan, Tung-Yang, Hsin-Chun Chiayi City (TW)

( * ) Notice: Subject to any disclaimer, the term of this patent is extended or adjusted under 35 U.S.C. 154(b) by 0 days.

(21) Appl. No.: 09/561,732

(22) Filed: Apr. 27, 2000

(51) Int. Cl.[7] ..... F41A 19/00

(52) U.S. Cl. ..... 124/31; 124/32; 124/63; 124/72

(58) Field of Search ..... 124/63, 72, 71, 124/31, 32; 89/132

(56) References Cited

U.S. PATENT DOCUMENTS 3,548,801 * 12/1970 Lohr et al. ..... 124/6
4,694,815 * 9/1987 Hung ..... 124/27
5,261,384 * 11/1993 Hu ..... 124/66
5,497,758 * 3/1996 Dobbins et al. ..... 124/73
5,771,875 * 6/1998 Sullivan ..... 124/72
5,954,042 * 9/1999 Harvey ..... 124/51.1
6,142,137 * 11/2000 MacLaughlin ..... 124/72
6,152,125 * 11/2000 Piper ..... 124/59
6,164,002 * 12/2000 Troncoso ..... 42/69.01

* cited by examiner

*Primary Examiner*—Charles T. Jordan
*Assistant Examiner*—John W. Zerr
(74) *Attorney, Agent, or Firm*—Pro-Techtor International Services

(57) ABSTRACT

An air gun trigger system, working in conjunction with an air gun, having a firing system, moving between a rear position in a ready state and a forward position for firing bullets, the air gun trigger system comprising: a holding element; a first trigger device; a second trigger device; and a driving unit. The holding element holds the firing system in the ready state and when triggered releases the firing system therefrom to move towards the forward position. The first trigger device is manually operated to trigger the holding element. The second trigger device automatically triggers the holding element and is driven by the driving unit. Thus the holding element is triggered to release the firing system from the ready state by either the first trigger device or the second trigger device. The driving unit causes a continuous movement of the second trigger device, resulting in fully automatic firing of bullets.

7 Claims, 13 Drawing Sheets

AIR GUN TRIGGER SYSTEM

BACKGROUND OF THE INVENTION

1. Field of the Invention

The present invention relates to an air gun trigger system for use in an air gun, particularly to an air gun trigger system allowing continuous automatic firing.

2. Description of Related Art

Air guns for rifle shooting contests are divided into single-loaders and semiautomatic or fully automatic repeating guns. Firing bullets from air guns is usually driven by compressed air that is stored in a high-pressure gas container A conventional semiautomatic air gun has a lock driven back by compressed gas when firing bullets and thus has a simple structure. However, since gas pressure directly drives the firing, firing is too fast with no way to be slowed down. Therefore, air guns that are directly driven by compressed gas can only be operated semiautomatically, with firing of one bullet at a time. Semiautomatic air guns are simple, but do not completely fulfill user demands.

A conventional fully automatic repeating gun of another type has a bi-directional gas pressure vessel for driving bullets to be fired. Entering of gas into the gas pressure vessel is controlled by an electromagnetic control valve to achieve fully automatic repeated firing.

However, since for fully automatic operation a bi-directional gas pressure vessel for driving bullets and an electromagnetic control valve have to be installed, a fully automatic repeating gun has a complicated structure, which is expensive. Furthermore, an electromagnetic control valve of a type used in air guns is not able to withstand a gas pressure of more than 180 psi. Normally, air guns operate at a gas pressure of about 600 psi. For this reason, a fully automatic air gun needs to be equipped with an additional reduction valve at the entrance of the electromagnetic control valve. This additionally complicates the structure of the air gun and adds to costs.

The reason for high costs of fully automatic air guns is, for restricting firing rates to about 180 shots per minute, the need to install bi-directional gas pressure vessels and electromagnetic control valves, which have refined and expensive structural parts.

SUMMARY OF THE INVENTION

It is the main object of the present invention to provide an air gun trigger system with a simple structure and low cost.

Another object of the present invention is to provide an air gun trigger system which supports fully automatic operation with a controlled firing rate by mechanical means.

The present invention can be more fully understood by reference to the following description and accompanying drawings.

DETAILED DESCRIPTION OF THE PREFERRED EMBODIMENTS

Figure 1:
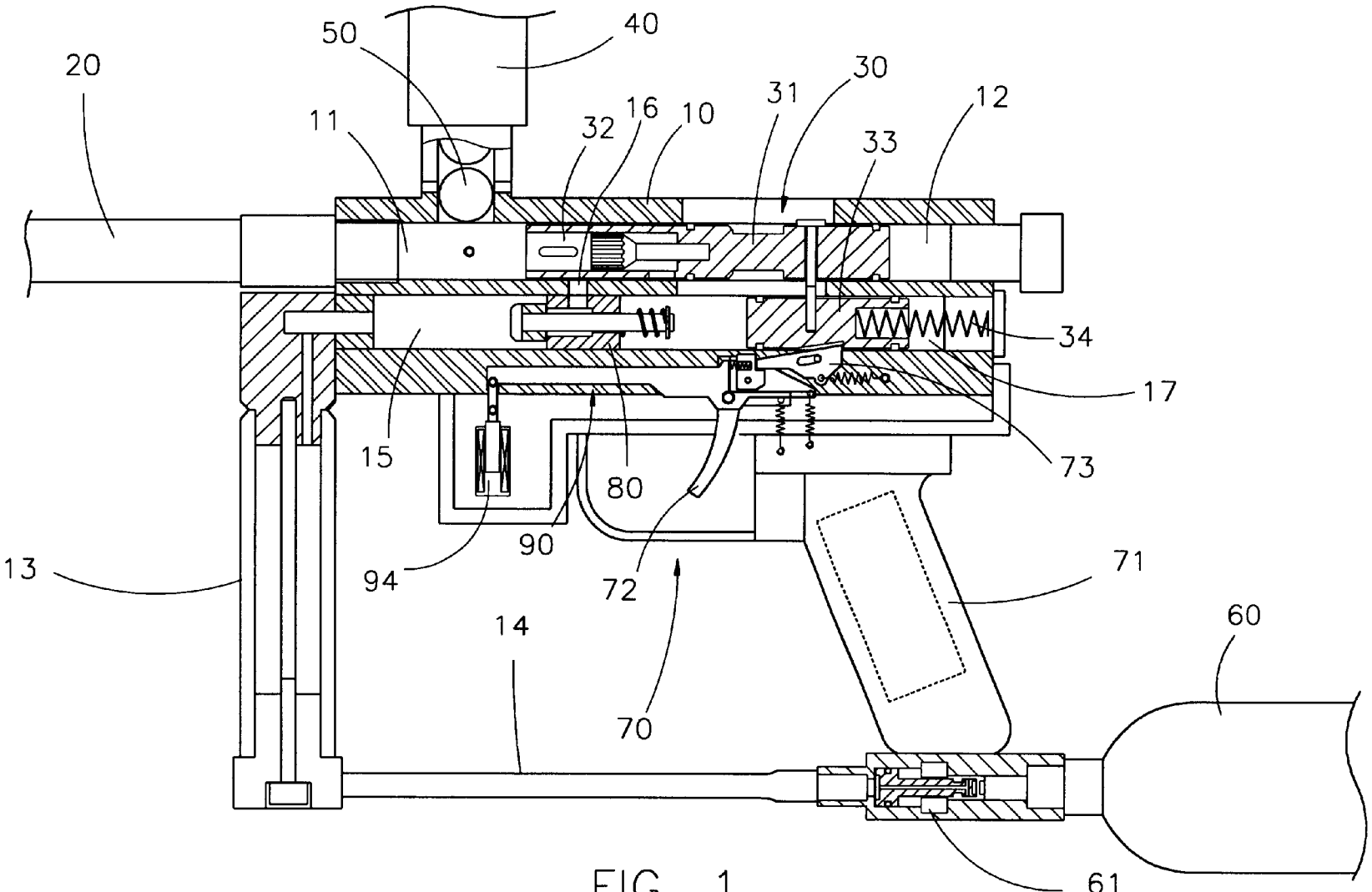
FIG. 1 is a sectional side view of the air gun trigger system of the present invention in the first embodiment in conjunction with an air gun.

As shown in FIG. 1, the air gun trigger system of the present invention is used in conjunction with an air gun, having: a main body 10 with an upper side, a lower side, a front end and a rear end, defining a longitudinal direction, with a bullet chamber 11 located at the front end of the main body 10; a barrel 20, having a rear end that is attached to the front end of the main body 10; a firing device 30 inside the main body 10, controlling firing of a bullet 50 from the bullet chamber 11 through the barrel 20; a feeding mechanism 40 on the upper side of the main body 10, feeding further bullets into the bullet chamber 11 to be fired from there; a high-pressure gas container 60, supplying gas for driving the bullet 50 to be fired; a control valve 80; and a pressure-reducing valve 61.

The air gun trigger system of the present invention mainly comprises: a holding element 73, connected with the firing device 30 and holding the firing device 30 in a ready state; and a trigger device 70 which, operated by a user, separates the holding element 73 from he firing device 30 and thus triggers operation thereof. The control valve 80 opens when pushed by the firing device 30, allowing compressed gas to flow into the bullet chamber 11 and drive out the bullet 50. The pressure-reducing valve 61 reduces pressure from the high-pressure gas container 60 to medium pressure for driving the bullet 50.

A handle 13 is attached to the lower side of the main body 10. The handle 13 contains a cylindrical chamber with a lower end which is connected with the high-pressure gas container 60 via a connecting tube 14. The high-pressure gas container 60 has an outlet on which the pressure-reducing valve 61 is set. The pressure-reducing valve 61 reduces pressure from the high-pressure gas container 60 to a value of about 600 psi, which is appropriate for driving the bullet 50. The main body 10 contains a pressure-storing chamber 15, located below the bullet chamber 11. A conduit 16 connects the pressure-storing chamber 15 and the bullet chamber 11, leading pressurized gas into the bullet chamber 11. The control valve 80 is positioned between the pressure-storing chamber 15 and the bullet chamber 11, opening and closing the conduit 16, thus controlling entrance of pressurized gas into the bullet chamber 11.

Figure 2:
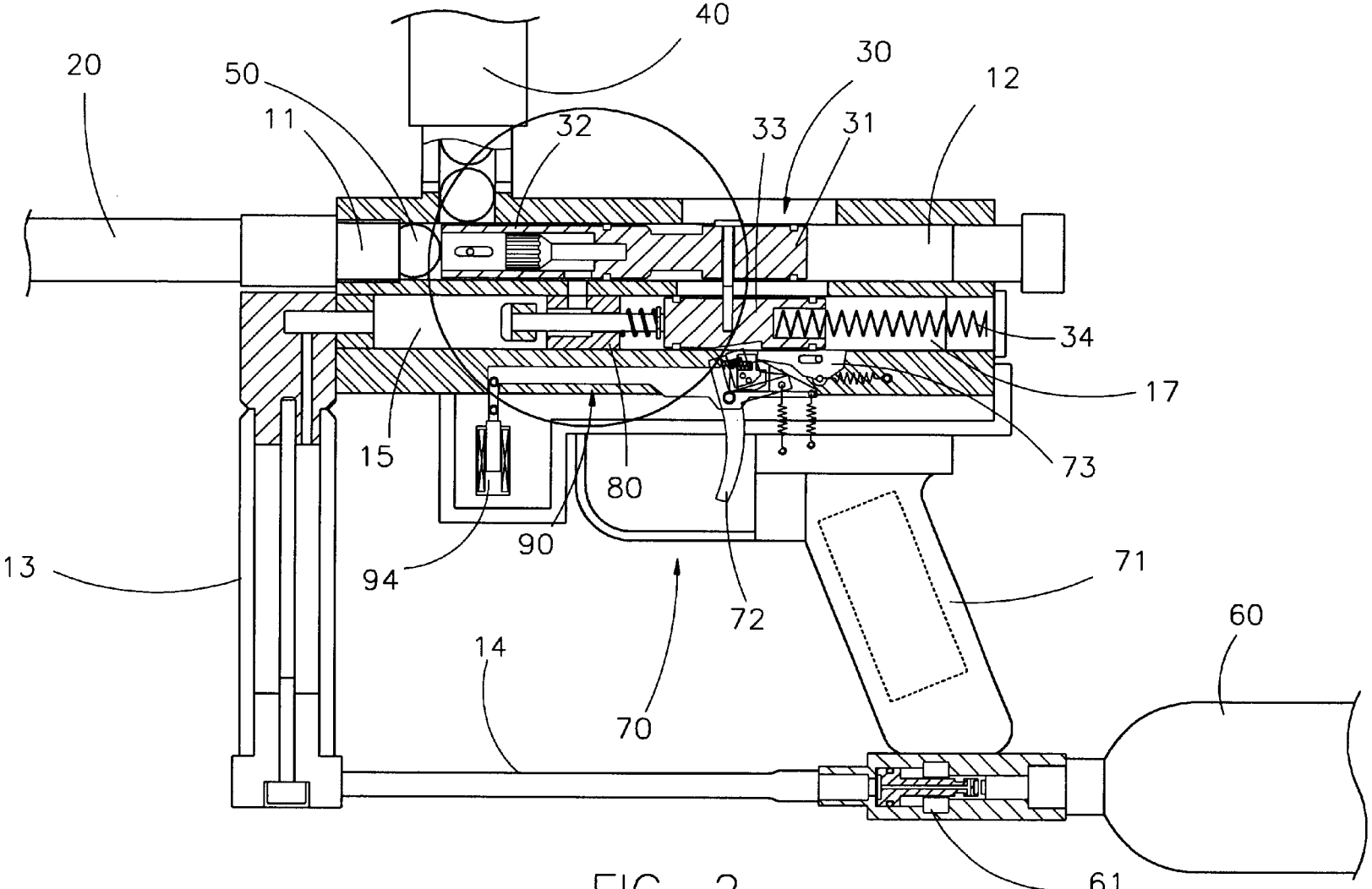
FIG. 2 is a sectional side view of the present invention in the first embodiment in conjunction with an air gun during firing of a bullet.

For accommodating the firing device 30, an upper accommodation chamber 12 is located inside the main body 10 to the rear of the bullet chamber 11, and a lower accommodation chamber 17 is located below the upper accommodation chamber 12. The firing device 30 comprises: a lock 31 with a front end, a rear end and a lower side; a lock head 32, attached to the front end of the lock 31 and having a front end; a lock base 33, fixed to the lock 31 on the lower side thereof; and a spring 34. The lock 31 and the lock base 33 are glidingly movable inside the upper and lower accommodation chambers 12, 17 in the longitudinal direction between rear and forward positions. As shown in FIG. 2, when the lock 31 moves towards the forward position thereof, the bullet chamber 11 is sealed, and the lock head 32 pushes the bullet 50 delivered by the feeding mechanism 40 into the bullet chamber 11. Then the lock base 33 pushes against the control valve 80, opening the control valve 80. The spring 34 presses the lock base 33 towards the forward position thereof.

As further shown in FIG. 1, in a ready state of the air gun trigger system of the present invention, the lock 31 and the lock base 33 of the firing device 30 are held in the rear positions thereof by the trigger device 70. In the ready state, the spring 34 is compressed by the lock base 33, storing an elastic force. As shown in FIG. 2, the trigger device 70, when operated, releases the lock 31 and the lock base 33, which are then pushed forward by the elastic force of the spring 34. This leads to the lock 31 pushing the bullet 50 into the bullet chamber 11 and the lock base 33 opening the control valve 80 (further explained below), so that compressed gas enters the bullet chamber 11 and the bullet 50 is driven out through the barrel 20.

Figure 2A:
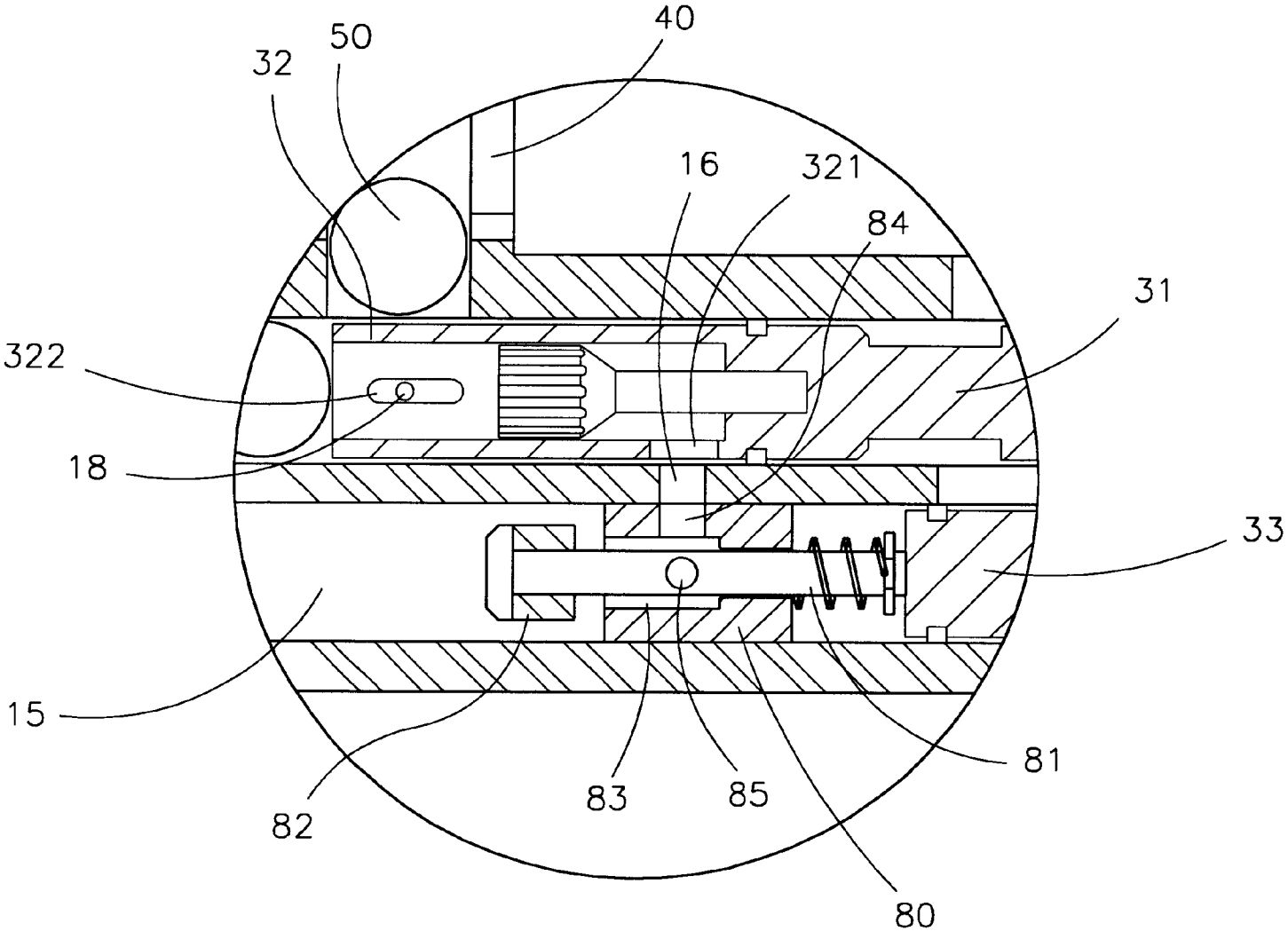
FIG. 2A is an enlarged sectional side view of the control valve of the present invention.

Referring to FIG. 2A, the control valve 80 has a valve rod 81, glidingly movable inside the control valve 80 along the longitudinal direction. The valve rod 81 has a front end, extending into the pressure-storing chamber 15 through an opening 83 and carrying a sealing element 82, and a rear end that points to the lock base 33. Pushing the lock base 33 on the rear end of the valve rod 81 separates the sealing element 82 from the opening 83. An outlet 84, cut into the control valve body 80 connects the opening 83 with the conduit 16. When the sealing element 82 is separated from the control valve 80, compressed gas from the pressure-storing chamber 15 enters the control valve 80 through the opening 83 and is led through the outlet 84 and the conduit 16 into the bullet chamber 11. Furthermore, as shown in FIG. 2A, the lock head 32 is shaped like a tube with a lower side into which an opening 321 is cut. When the lock 31 seals the bullet chamber 11, the opening 321 is in a position matching the conduit 16, allowing compressed gas to enter the lock head 32. Subsequently, compressed gas leaves the lock head 43*a* through the front end thereof. Thus a strong force is generated that drives the bullet 50 through the barrel 20.

In order to have the lock 31 return to the rear position thereof after firing the bullet 50, several side holes 85 are cut into the control valve 80. The side holes 85 are connected with pushing inlets 18 in the bullet chamber 11. As shown in FIG. 2A, several elongated holes 322 are cut into the lock head 32 along the longitudinal direction. After driving out the bullet 50, the elongated holes 322 match in position the pushing inlets 18. Then compressed gas enters the lock head 32 through the elongated holes 322, and a counterforce develops that pushes the lock 31 towards the rear position thereof.

Combined operation of the trigger device 70, the firing device 30, the holding element 73 and the control valve 80 achieves firing of the bullet 50. After firing, the firing device 30 returns to the rear position thereof, restoring the ready state of the air gun trigger system.

Figure 3:
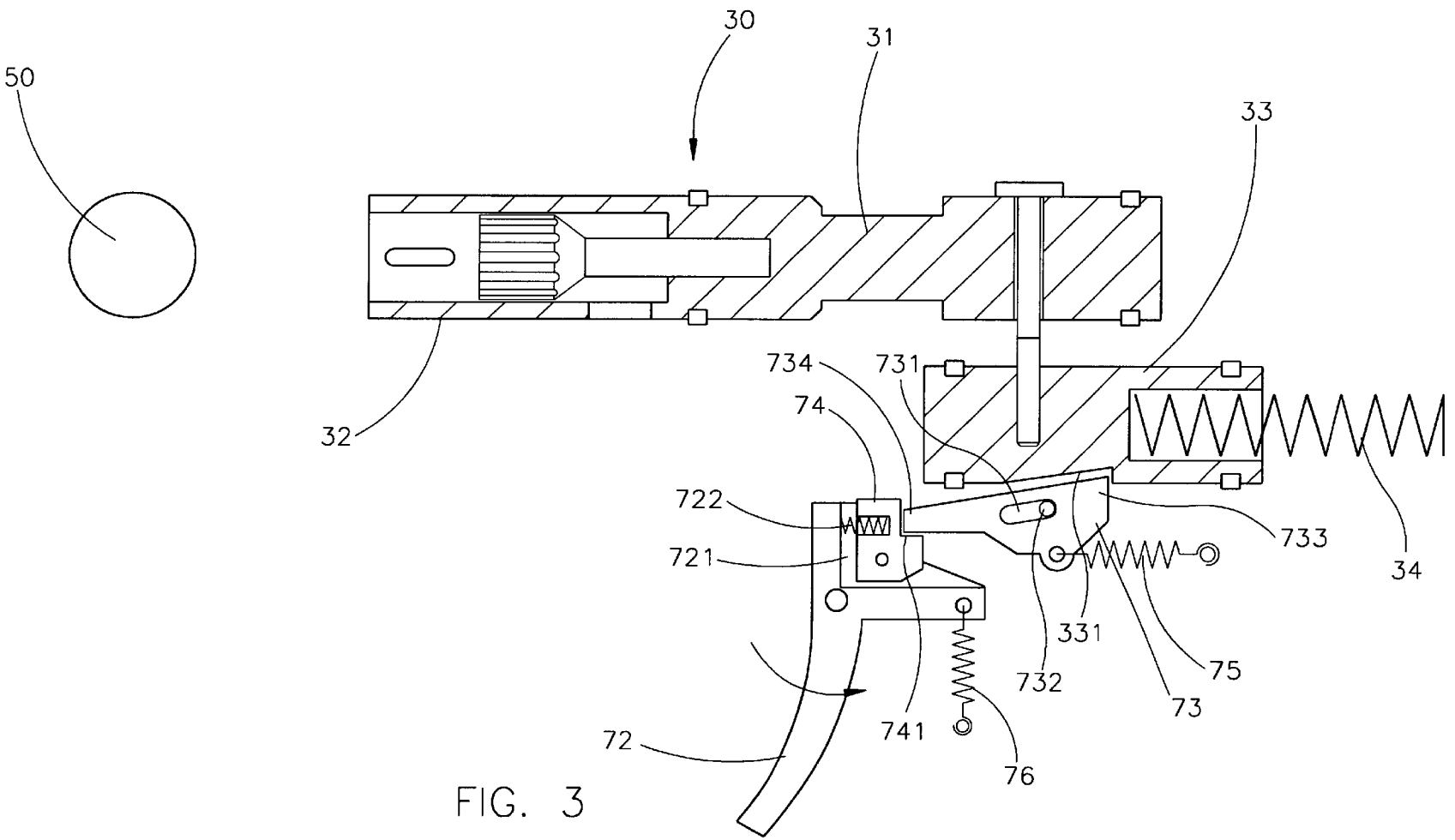
FIG. 3 is a sectional side view of the triggering device and the firing device of the present invention in the first embodiment.

Referring to FIGS. 1 and 3, the trigger device 70 is accommodated in a space below the rear end of the main body 10. The trigger device 70 comprises: a handle 71; a trigger 72 with an upper end and a lower end; the holding element 73; a turning piece 74 with a front side and a rear side; a spring 75; and a spring 76. The trigger 72 is operated manually by pulling back the lower end thereof. The holding element 73 is located below the firing device 30. The lock base 33 of the firing device 30 has a lower side with a tooth 331. In the rear position of the lock base 33 the holding element 73 is engaged with the tooth 331, blocking the firing device 30 from leaving the rear position thereof. The turning piece 74 is connected with the upper end of the trigger 72. When the trigger 72 is pulled back, the turning piece 74 turns, disengaging the holding element 73 from the tooth 331 and allowing the firing device 30 to move forward for firing the bullet 50, as shown in FIG. 4.

Figure 4:
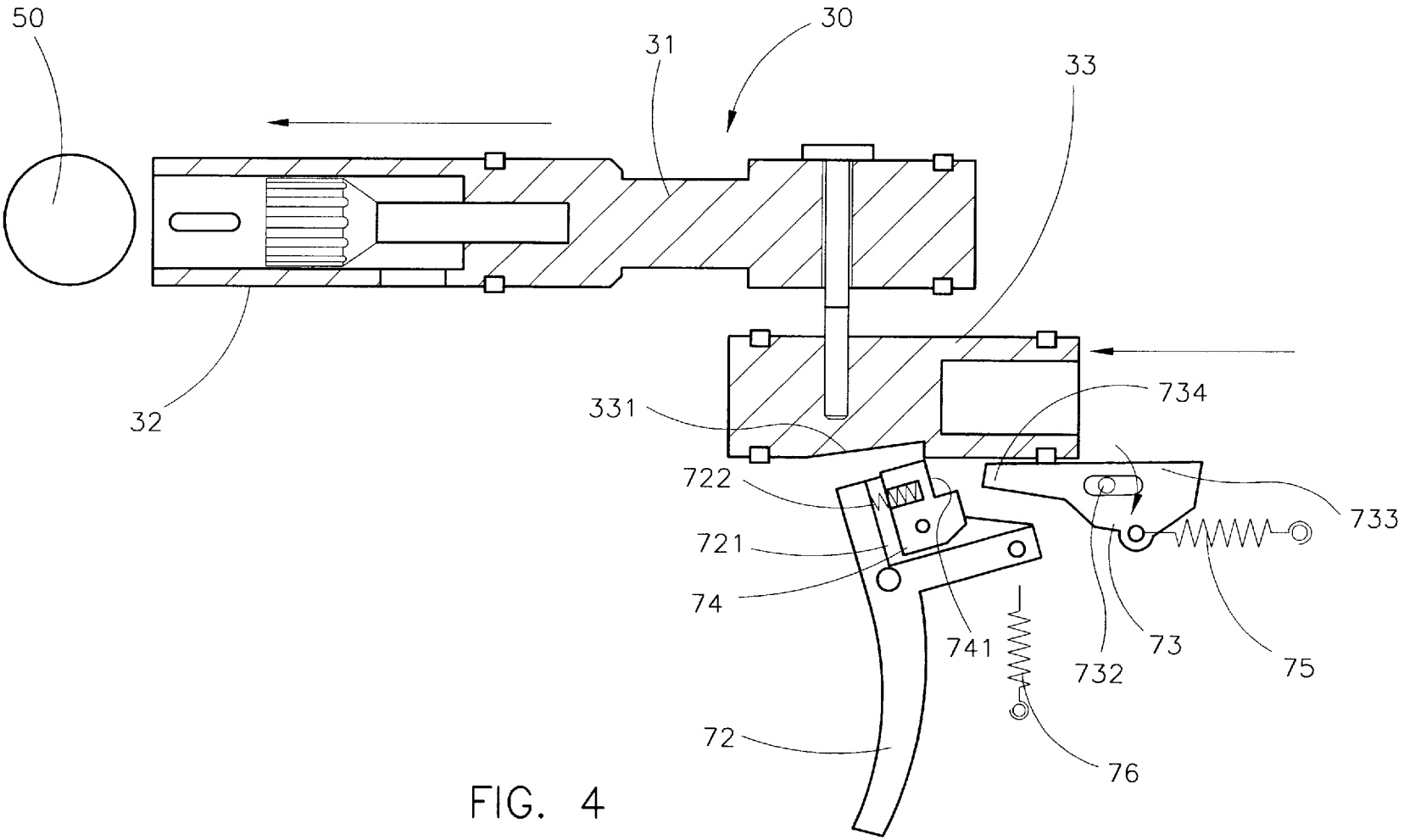
FIG. 4 is a schematic illustration of the triggering device of the present invention in the first embodiment during firing of a bullet.

Referring to FIGS. 3 and 4, the holding element 73 is roughly shaped like a wedge, having a central elongated hole 731. A bolt 732, passing through the elongated hole 731, keeps the holding element 73 in place, while allowing the holding element 73 to turn and slightly to move forward and backward. The holding element 73 has a rear end with a nose 733 for engaging with the tooth 331 and a front end with a lever 734 to be pushed up by the turning piece 74. When the trigger 72 is pulled back, the turning piece 74 pushes the lever 734 upward, lowering the rear end of the holding element 73 and causing the nose 733 to disengage from the tooth 331.

Figure 5:
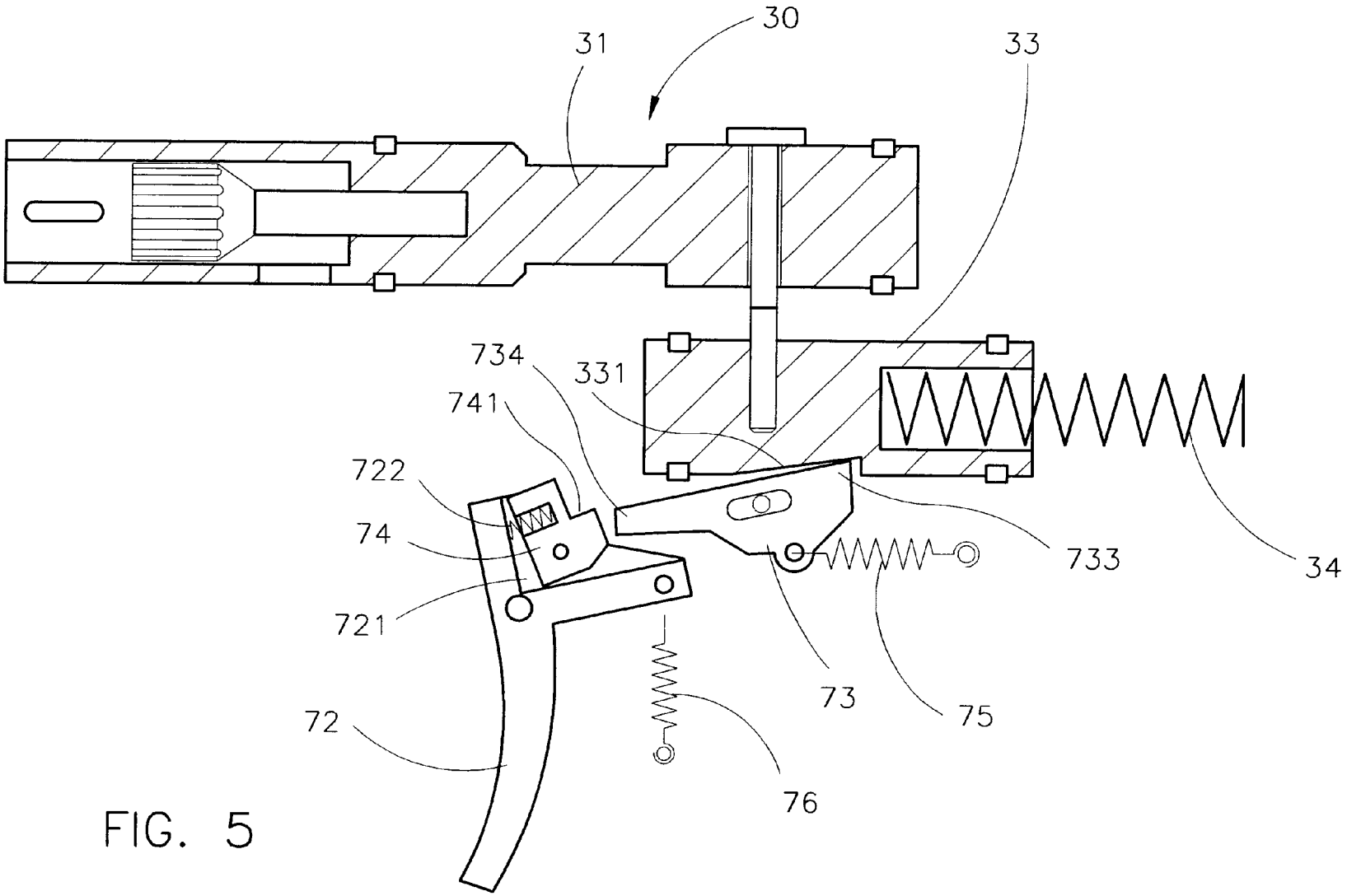
FIG. 5 is a schematic illustration of the triggering device of the present invention in the first embodiment returning to the ready state before firing of a bullet.

As shown in FIG. 5, after firing the bullet 50, the firing device 30 is driven towards the rear position thereof by compressed gas. At this time, the turning piece 74 is disconnected from the holding element 73, so that the lock base 33 presses down the rear end of the holding element 73 unhindered. As soon as the tooth 331 of the lock base 33 has moved past the nose 733 of the holding element 73, the spring 75 pulls up the rear end of the holding element 73, causing the nose 733 to engage with the tooth 331 again, so that the lock base 33 is held in the rear position thereof. Then the trigger 72 is ready to be pulled again.

Referring again to FIG. 5, the trigger 72 drives the holding element 73 via the turning piece 74. The trigger 72 and the front side of the turning piece 74 are separated by a gap 721. The turning piece 74 has a shoulder 741 on the rear side thereof. A spring 722 across the gap 721 pushes the turning piece 74 away from the trigger 72. In the ready state, with the trigger 72 not pulled, as shown in FIG. 3, the shoulder 741 engages with the lever 734 of the holding element 73. Pulling of the trigger 72, as shown in FIG. 4, lifts the shoulder 741, raising the lever 734 and lowering the nose 733 of the holding element 73.

After the bullet 50 has been fired, the shoulder 741 of the turning piece 74 is still separated from the holding element 73. After releasing of the trigger 72, the spring 76 pulls forward the trigger 72, with the front end of the holding element 73 touching the shoulder 741, causing the turning piece 74 to lean against the trigger 72. Having been lowered below the front end of the holding element 73, the shoulder 741 engages with the lever 734, pressed thereon by the spring 722.

The trigger device 70 allows semiautomatic operation of the air gun. Even if the trigger 72 is pulled each time, after firing of a bullet, the firing device 30 returns to the rear position thereof and is held there.

The firing device 30, the pressure-reducing valve 61 and the trigger device 70 of the present invention, used in conjunction with the main body 10, are parts that are used in conventional semiautomatic guns. Therefore conventional structural parts can be employed.

Figure 6:
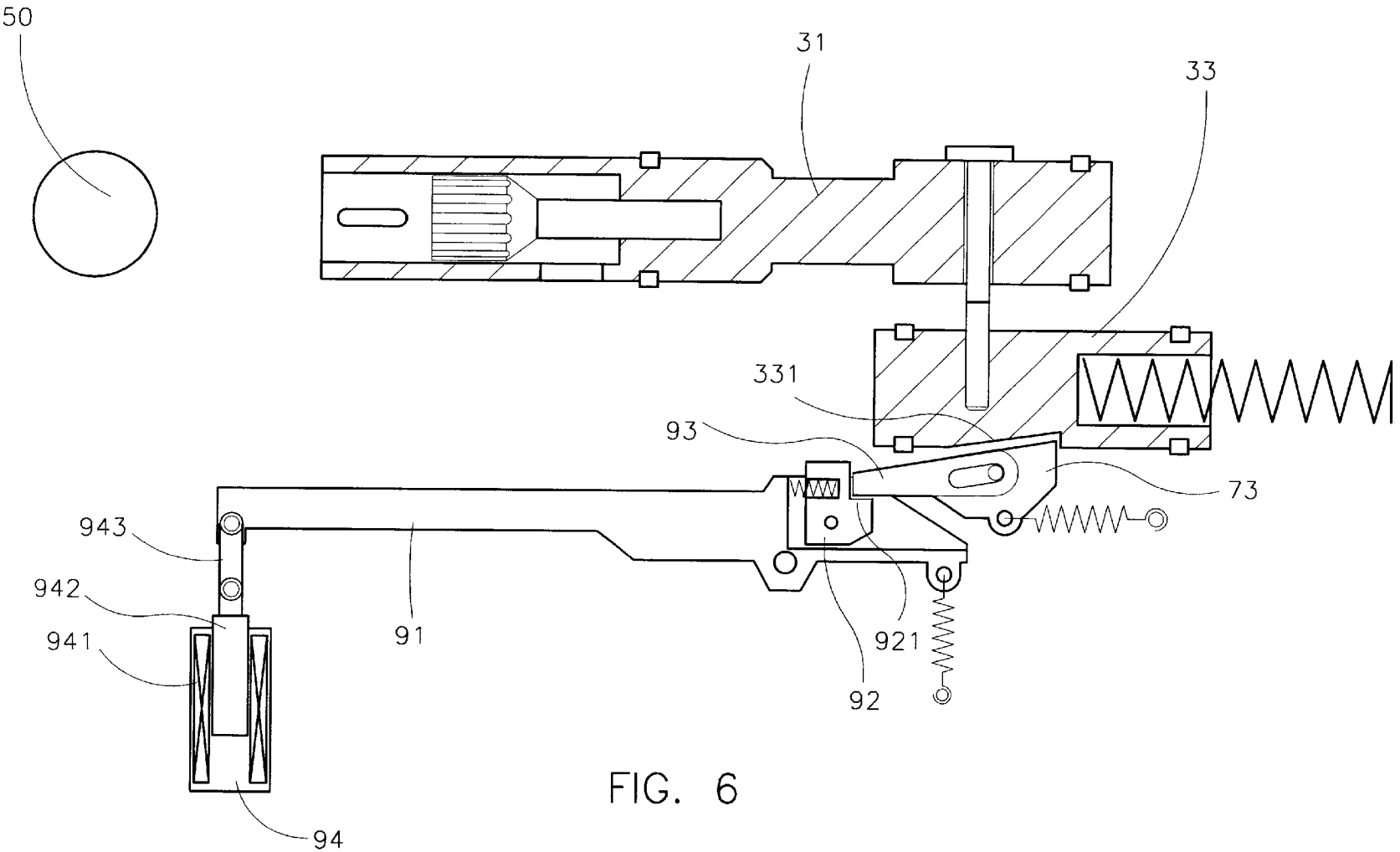
FIG. 6 is a schematic illustration of the second triggering device of the present invention in the first embodiment in the ready state before firing of a bullet.

The main characteristic of the present invention is a second trigger device 90 for fully automatic operation of the firing device 30 at a determined speed. As shown in FIGS. 1 and 6, the second trigger device 90 comprises: a second trigger 91; a second turning piece 92; a second holding element 93; and a driving unit 94. The second trigger 91 is placed on a common axis with the trigger 72, having a front end and a rear end. The second turning piece 92 is mounted at the rear end of the second trigger 91. The second holding element 93 is linked with the holding element 73 on a common axis, having a front end. The second turning piece 92 pushes up the second holding element 93 on the front end thereof. Since the second holding element 93 is fixed to the holding element 73, pushing up the second holding element 93 causes the firing device 30 to move forward for firing. The second turning piece 92 has a shoulder 921, engaging with the front end of the second holding element 93. Driving of the second holding element 93 by the second turning piece 92 is performed like driving of the holding element 73 by the turning piece 74 and does not need further explanation.

The driving unit 94 is connected with the second trigger 91 on the front end thereof, driving a swaying movement thereof for turning the second turning piece 92 and subsequently moving the second holding element 93.

As shown in FIG. 6, the driving unit 94 comprises: an electromagnetic coil 941; a driven rod 942, having a free upper end; and a link rod 943, connecting the driven rod 942 on the upper end thereof and the second trigger 91 on the front end thereof. The driven rod 942 is inserted into the electromagnetic coil 941 and about vertically oriented with respect to the second trigger 91. Preferably the driven rod 942 is made of magnetic material, allowing to drive the driven rod 942 in and out of the electromagnetic coil 941 by an alternating current to perform a vertical movement.

Figure 7:
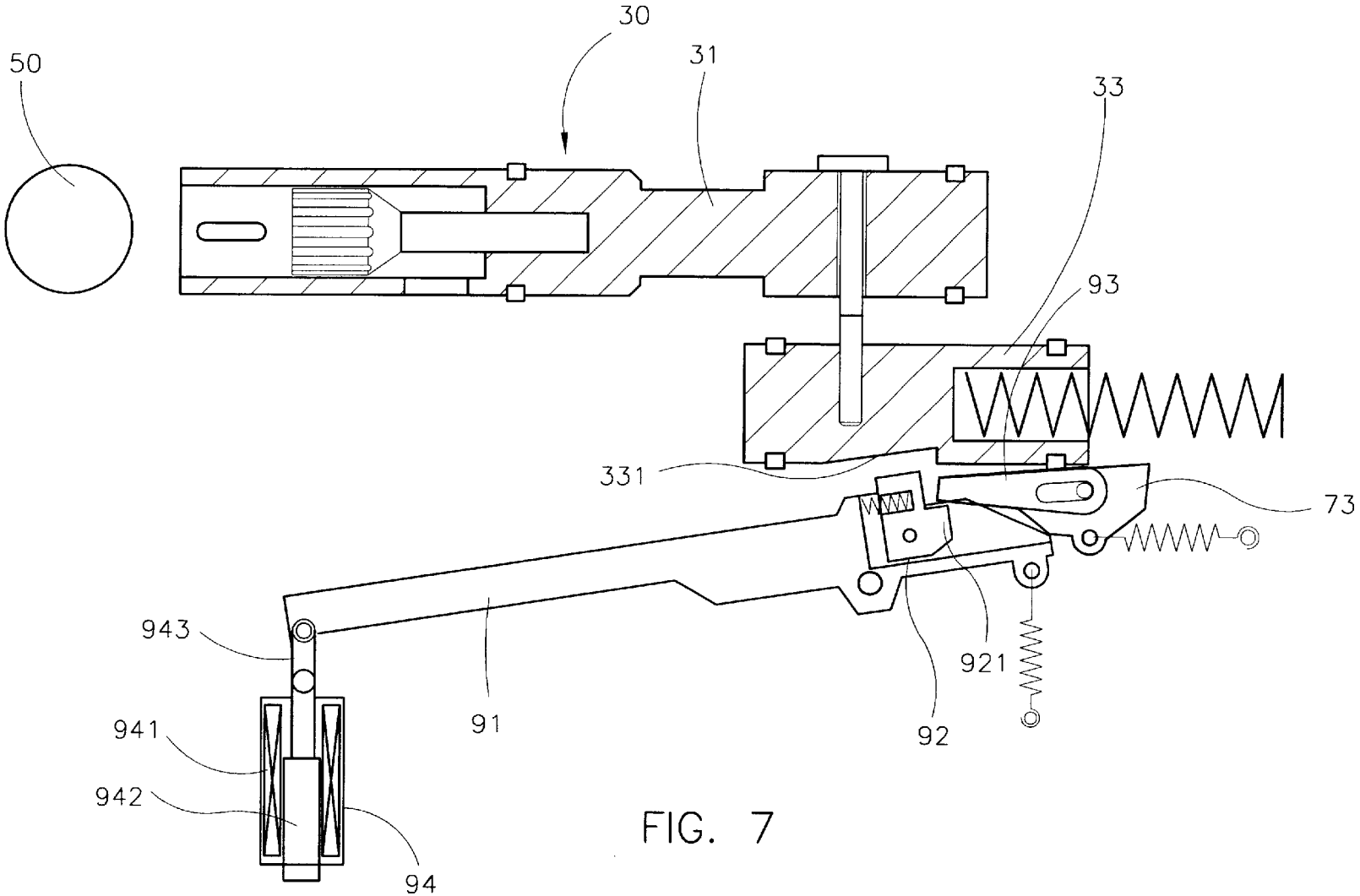
FIG. 7 is a schematic illustration of the second triggering device of the present invention in the first embodiment during firing of a bullet.
Figure 8:
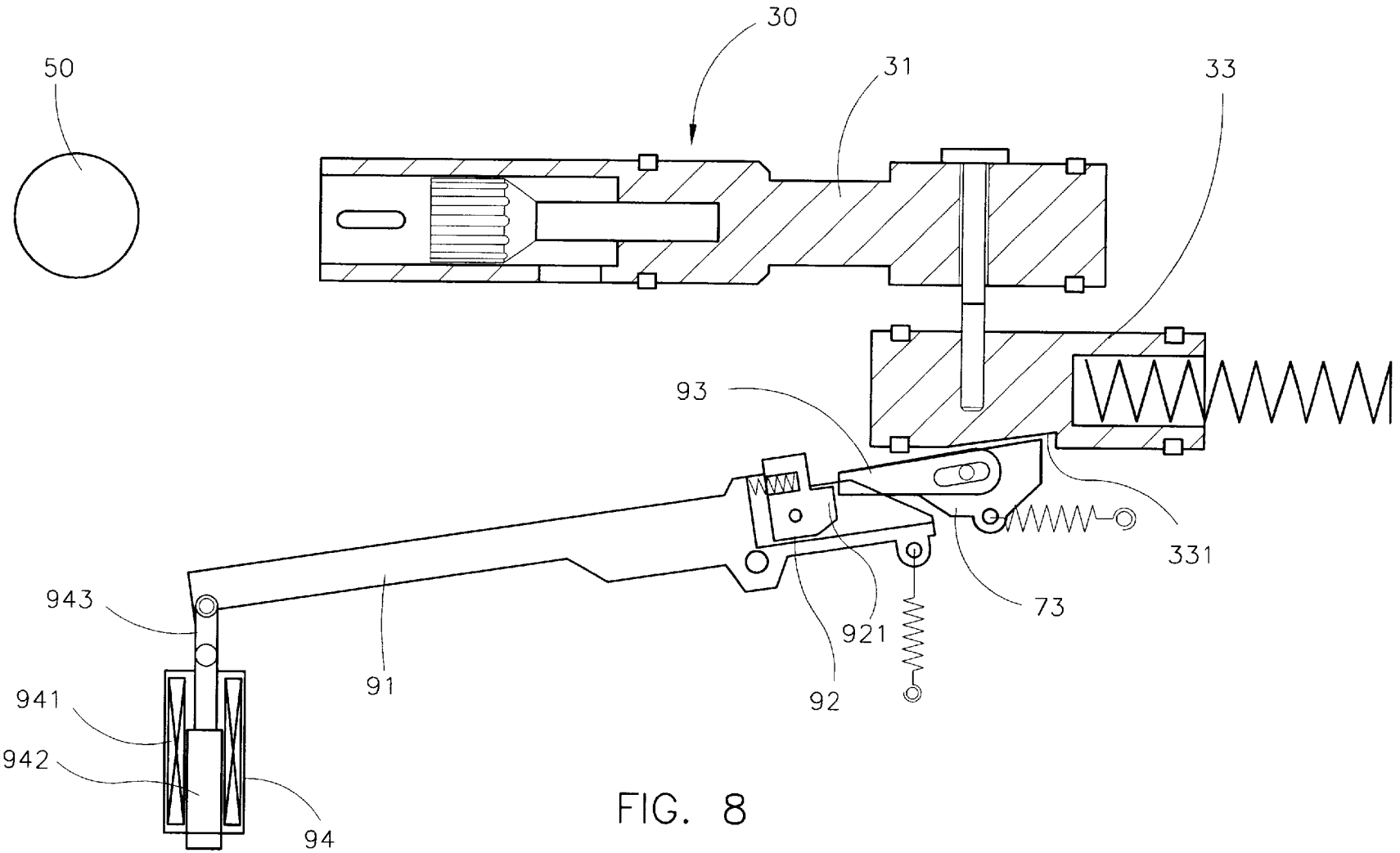
FIG. 8 is a schematic illustration of the second triggering device of the present invention in the first embodiment returning to the ready state before firing of a bullet.

Referring to FIG. 7, when the driven rod moves downward, the front end of the second trigger 91 is lowered, causing the second turning piece 92 to push up the second holding element 93, so that the tooth 331 of the lock base 33 is released and the firing device moves forward to fire the bullet 50. As shown in FIG. 8, when the firing device 30 returns to the rear position thereof, the tooth 331 again engages with the holding element 73, keeping the firing device 30 in the rear position thereof.

Since the second holding element 93 is linked with the holding element 73 of the trigger device 70, the second trigger device 90 controls moving of the firing device 30 in the same way as the trigger device 70. Furthermore, since the second trigger device 90 is controlled by the current through the electromagnetic coil 941 to perform a periodic movement, fully automatic firing by the firing device 30 is achieved.

In comparison with a conventional fully automatic gun, the present invention allows fully automatic operation by mechanical means without any need to install a bi-directional gas pressure vessel and an electromagnetic control valve. This simplifies the structure of the air gun and reduces cost. Furthermore, since no electromagnetic control valve is needed, the pressure-reducing valve 61 on the high-pressure gas container 60 is sufficient to reduce gas pressure to the needed level. No additional reduction valve at the entrance of the electromagnetic control valve is necessary, further simplifying the structure of the air gun and reducing cost.

Figure 9:
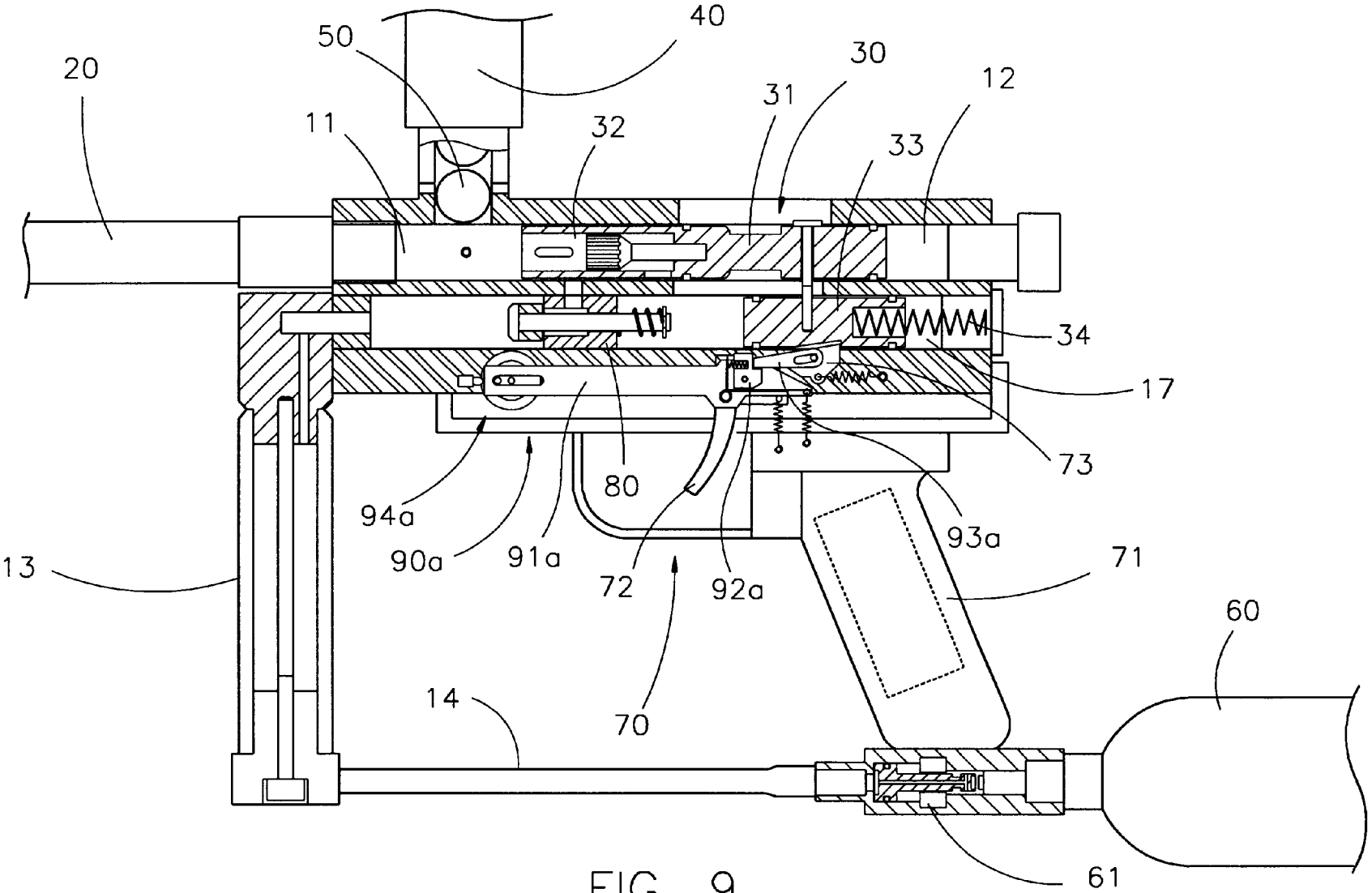
FIG. 9 is a sectional side view of the air gun trigger system of the present invention in the second embodiment in conjunction with an air gun.

Referring to FIG. 9, the present invention in a second embodiment has a second trigger device 90*a*, comprising: a second trigger 91*a*; a second turning piece 92*a*; a second holding element 93*a*; and a driving unit 94*a*. The second trigger 91*a* is placed on a common axis with the trigger 72, having a front end and a rear end. The second turning piece 92*a* is mounted at the rear end of the second trigger 91*a*. The second holding element 93*a* is linked with the holding element 73 on a common axis, having a front end. The second turning piece 92*a* pushes up the second holding element 93*a* on the front end thereof. The driving unit 94*a* drives a swaying movement of the second trigger 91*a*.

Figure 10:
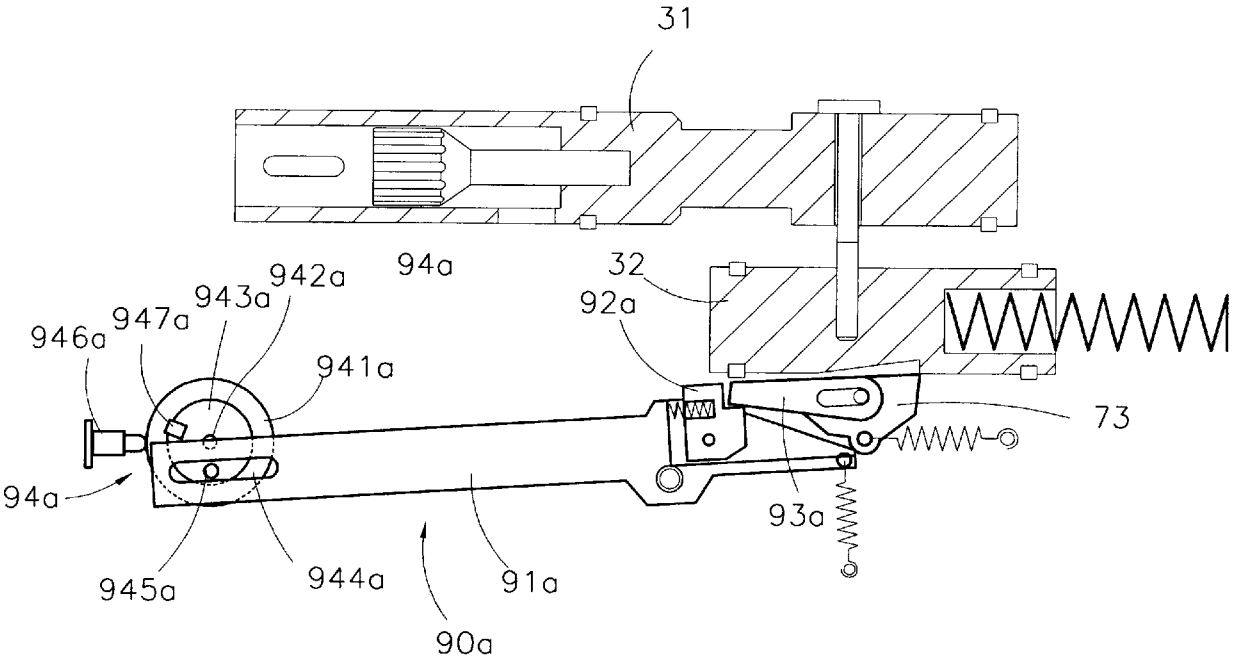
FIG. 10 is a schematic illustration of the second triggering device of the present invention in the second embodiment during firing of a bullet.
Figure 10A:
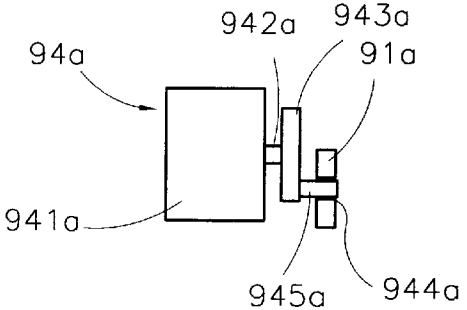
FIG. 10A is a front view of the driving device of the present invention in the second embodiment.

Referring to FIGS. 10 and 10*a*, the driving unit 94*a* comprises: a motor 941*a*; a shaft 942*a*, driven by the motor 941*a*; an disk 943*a*, set on the shaft 942*a*; a groove 944*a* on the front end of the second trigger 91*a*; and an eccentric rod 945*a*, vertically extending away from the disk 943*a* and engaging with the groove 944*a*; a detector 946*a*; and a transmitter 947*a*, fixed on the disk 943*a* and indicating an angular position thereof.

As shown in FIGS. 10 and 10*a*, when the disk 943*a* rotates, the eccentric rod 945*a* glides back and forth within the groove 944*a*, causing the second trigger 91*a* to perform the swaying movement thereof. Consequently the second turning piece 92*a* and the second holding element 93*a* are driven.

Furthermore, as shown in FIG. 10, for ensuring that the second trigger 91*a* performs a periodic movement with identical starting positions, the detector 946*a* senses the angular position of the disk 943*a*, as indicated by the transmitter 947*a*, and controls switching off of the motor 941*a* according to the angular position sensed. Thus the second trigger 91*a* always returns to identical starting positions.

Figure 11:
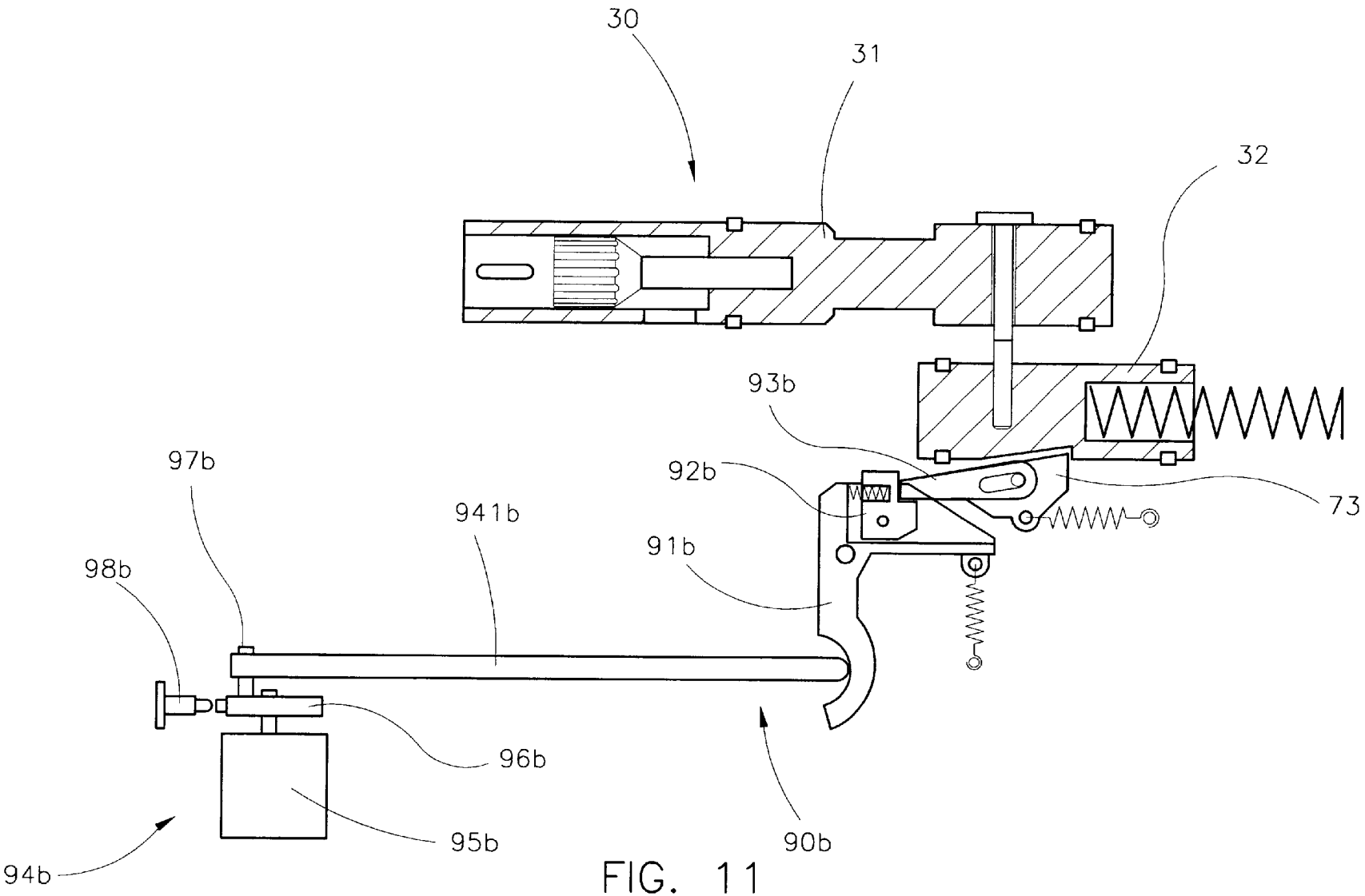
FIG. 11 is a sectional side view of the second triggering device of the present invention in the third embodiment.
Figure 12:
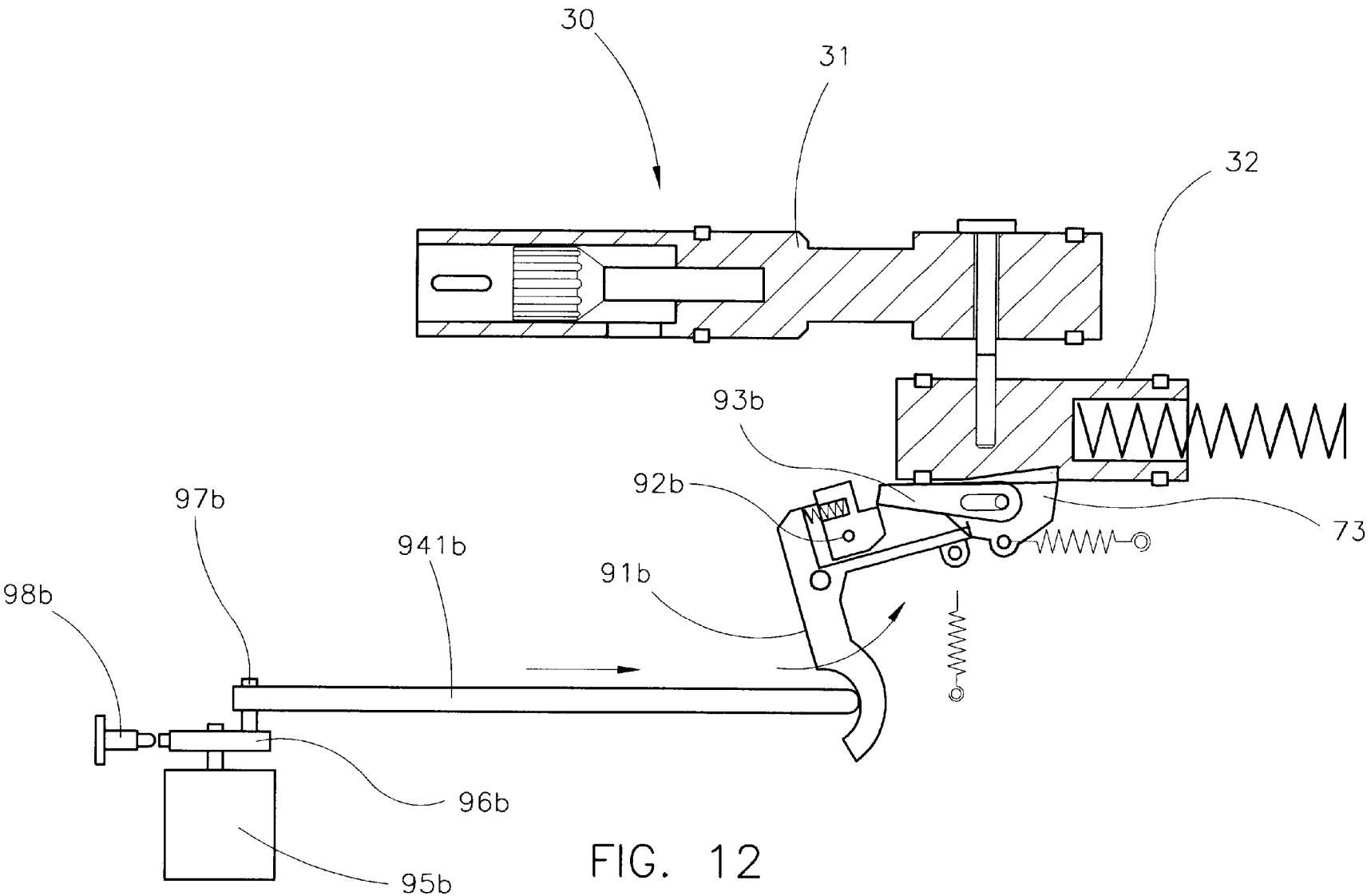
FIG. 12 is a schematic illustration of the movement of the second triggering device of the present invention in the third embodiment.

Referring to FIG. 11, the present invention in a third embodiment has a second trigger device 90*b*, comprising: a second trigger 91*b*, movable inside the main body 10; a second turning piece 92*b*, mounted at the second trigger 91*b*; a second holding element 93*b*; and a driving unit 94*b*. The second holding element 93*b* is linked with the holding element 73, thereby driving the lock 31, as driven by the second turning piece 92*b*. The driving unit 94*b* drives a swaying movement of the second trigger 91*b*. The driving unit 94*b* comprises: a driving rod 941*b* with a front end and a rear end; a motor 95*b*, with a shaft attached to the motor 95*b*; a disk 96*b*, set on the shaft and rotating, as driven by the motor 95*b*, having a varying angular position; an eccentric rod 97*b*; and a detector 98*b*. The eccentric rod 97*b* is attached to the disk 96*b* and connected with the driving rod 941*b* at the front and thereof. The detector senses the angular position of the disk 96*b*. As shown in FIG. 12, when the disk 96*b* rotates, the eccentric rod 97*b* is taken along, driving the driving rod 941*b* in a linear movement along the longitudinal direction. A movement to the rear of the driving rod 941*b* pushes back the second trigger 91*b*, causing the second turning piece 92*b* to lift the second holding element 93*b*, with the holding element 73 being taken along, resulting in the lock 31 to move forward for firing.

While the invention has been described with reference to preferred embodiments thereof, it is to be understood that modifications or variations may be easily made without departing from the spirit of this invention which is defined by the appended claims.

What is claimed is:

1. An air gun trigger system, working in conjunction with an air gun, having a firing system inside a main body, moving between a rear position in a ready state and a forward position for firing bullets, said air gun trigger system comprising:

a holding element, holding said firing system in said ready state and when triggered releasing said firing system therefrom to move towards said forward position;

a first trigger device, which is manually operated to trigger said holding element to release said firing system from said ready state and which, after firing of a bullet and after returning of the firing device to said rear position, engages with said holding element to hold said firing system;

a second trigger device, which automatically triggers said holding element to release said firing system from said ready state and which, after firing of a bullet and after returning of the firing device to said rear position, engages with said holding element to hold said firing system; and a driving unit, driving said second trigger device to release said firing system from said ready state;

wherein said holding element is triggered to release said firing system from said ready state by either said first trigger device or said second trigger device and wherein said driving unit causes a continuous movement of said second trigger device, resulting in fully automatic firing of bullets.

2. An air gun trigger system according to claim 1, wherein said holding element is hingedly mounted inside said main body, having a holding end, engaging with said firing device in said ready state, and an opposite triggered end, moved by said first trigger device or said second trigger device, causing said holding end to release said firing device.

3. An air gun trigger system according to claim 1, wherein said second trigger device further comprises:

a second trigger;

a second turning piece, mounted close to said second trigger;

a second holding element, linked to said holding element and triggered by said second turning piece to release said firing device.

4. An air gun trigger system according to claim 1, wherein said driving unit further comprises:

an electromagnetic coil; and a driven rod, connected with said second trigger and roughly perpendicularly oriented thereto, driven by a current in said electromagnetic coil to perform a linear movement, thus driving a swaying movement of said second trigger.

5. An air gun trigger system according to claim 1, wherein said driving unit further comprises:

a motor, having a shaft which is perpendicularly oriented to said second trigger;

a disk, set on said shaft;

a groove, cut into said second trigger;

an eccentric rod, attached to said disk and engaging with said groove, so that when said disk rotates, a swaying movement of said second trigger is driven.

6. An air gun trigger system according to claim 5, wherein said second trigger device further comprises:

a detector; and a transmitter, mounted on said disk, so that angular positions of said disk are sensed.

7. An air gun trigger system according to claim 1, wherein said driving unit further comprises:

a motor, having a shaft which is perpendicularly oriented to said second trigger;

a disk, set on said shaft;

a driven rod, performing a piston-like movement, as driven by said disk and driving a swaying movement of said second trigger.

* * * * *